US009823011B2

(12) United States Patent
Kempte

(10) Patent No.: US 9,823,011 B2
(45) Date of Patent: Nov. 21, 2017

(54) REFRIGERATING DEVICE COMPRISING A FLUIDICALLY CONDUCTIVE DOOR CONNECTION

(75) Inventor: Andreas Kempte, Zschopau (DE)

(73) Assignee: BSH Hausgeräte GmbH, Munich (DE)

( * ) Notice: Subject to any disclaimer, the term of this patent is extended or adjusted under 35 U.S.C. 154(b) by 724 days.

(21) Appl. No.: 12/085,137

(22) PCT Filed: Oct. 20, 2006

(86) PCT No.: PCT/EP2006/067632

§ 371 (c)(1),
(2), (4) Date: May 16, 2008

(87) PCT Pub. No.: WO2007/062922

PCT Pub. Date: Jun. 7, 2007

(65) Prior Publication Data

US 2009/0272142 A1 Nov. 5, 2009

(30) Foreign Application Priority Data

Nov. 30, 2005 (DE) ..... 10 2005 057 146

(51) Int. Cl.
*F25D 11/02* (2006.01)
*F25D 23/02* (2006.01)
(Continued)

(52) U.S. Cl.
CPC ..... *F25D 23/028* (2013.01); *E05D 11/0081* (2013.01); *F25D 23/126* (2013.01);
(Continued)

(58) Field of Classification Search
CPC . E05D 11/0081; F25D 23/126; F25D 23/028; F25D 2400/40; F25D 2323/024; E05Y 2900/31
(Continued)

(56) References Cited

U.S. PATENT DOCUMENTS 4,609,234 A * 9/1986 Naniwa ..... E05D 3/022 16/341
5,158,503 A 10/1992 Mitchell
(Continued)

FOREIGN PATENT DOCUMENTS

JP 59-56069 3/1984

OTHER PUBLICATIONS

International Search Report PCT/EP2006/067632.

*Primary Examiner* — J. Casimer Jacyna
(74) *Attorney, Agent, or Firm* — Nixon & Vanderhye P.C.

(57) ABSTRACT

A refrigerating device, in particular a refrigerator and/or a freezer cabinet, comprising a heat-insulating housing and a heat-insulating door. At least one component is provided on or in the door, said component being fluidically and/or electrically connected by means of a line to at least one element which is arranged on the housing. The door is articulated to the housing by means of a multilink hinge. A support, which supports the line when the door is open, is provided in the intermediate area between the door and the housing. The invention is characterised in that the inner chamber of the refrigerating device can be almost completely accessed, when a water dispensing unit is provided on the door and even with solid doors.

26 Claims, 3 Drawing Sheets

(51) Int. Cl.
*E05D 11/00* (2006.01)
*F25D 23/12* (2006.01)

(52) U.S. Cl.
CPC ..... *E05Y 2900/31* (2013.01); *F25D 2323/024* (2013.01); *F25D 2400/40* (2013.01)

(58) Field of Classification Search
USPC ..... 222/146.6, 146.5; 62/389, 390, 449
See application file for complete search history.

(56) References Cited

U.S. PATENT DOCUMENTS

| | | | | | |
|---|---|---|---|---|---|
| 5,263,509 | A | | 11/1993 | Cherry et al. | |
| 5,497,534 | A | * | 3/1996 | Caruso | 16/288 |
| 5,542,265 | A | * | 8/1996 | Rutland | 62/389 |
| 5,787,724 | A | * | 8/1998 | Pohl et al. | 62/389 |
| 5,931,554 | A | | 8/1999 | Koopman | |
| 6,303,031 | B1 | * | 10/2001 | Senner | 210/232 |
| 6,868,692 | B2 | * | 3/2005 | Choi | 62/389 |
| 7,322,209 | B2 | * | 1/2008 | Hwang et al. | 62/449 |
| 2004/0206106 | A1 | * | 10/2004 | Lee | 62/389 |
| 2005/0284159 | A1 | * | 12/2005 | Kim | F25D 23/028 62/126 |
| 2006/0064846 | A1 | * | 3/2006 | Espindola | E05D 11/0081 16/223 |
| 2006/0090498 | A1 | * | 5/2006 | Marret et al. | 62/389 |
| 2007/0204648 | A1 | * | 9/2007 | Smale et al. | 62/389 |
| 2007/0251261 | A1 | * | 11/2007 | Son | F25D 23/063 62/390 |

* cited by examiner

REFRIGERATING DEVICE COMPRISING A FLUIDICALLY CONDUCTIVE DOOR CONNECTION

BACKGROUND OF THE INVENTION

The invention relates to a refrigerating device, in particular a refrigerator and/or a freezer cabinet, comprising a heat-insulating housing and a heat-insulating door, whereby at least one component is provided on or in the door, said component being connected fluidically and/or electrically by means of a line to at least one element arranged on the housing.

Refrigerators are known which have in their door a water dispensing unit for cooled water or for ice and/or further electrical components. The routing of the electrical or the fluidic connection is realized in these devices either directly through the supporting point of the door mounting, by implementing the supporting point as a tube, or through a tube arrangement connecting the door and the device body, which is pulled out from an understructure of the device as the door opens.

With regard to these refrigerators, hinges having a single, rigid hinge axis are used as a rule. Such types of hinges are generally required against the background of the high demand for mechanical stability in particular in the case of heavy doors, as are generally present in the case of doors having a water dispensing unit. Their use allows comparatively great door forces to be accommodated without the hinge needing to have excessively large dimensions. Such types of hinges do however exhibit certain disadvantages in respect of their door position/door opening behavior. Thick doors in particular, such as are used for example in the case of refrigerators having a built-in water dispensing unit in the door, exhibit a comparatively unfavorable free opening cross-section. If for example the door is opened by an angle of 90°, part of the inner chamber of the refrigerator remains obstructed generally by approximately the thickness of the door, such that access to the inner chamber of the refrigerator is partially impaired by the door when these hinges are employed.

BRIEF SUMMARY OF THE INVENTION

The object of the present invention is to provide a refrigerating device, in particular a refrigerator or a freezer cabinet, which has a component in the door that is to be connected by means of a fluidic or electrical line and nevertheless gives the widest possible free access to the inner chamber of the refrigerating device when the door is opened.

This object is achieved according to the invention by the refrigerating device as specified in the independent claim. Further advantageous embodiments and developments, each of which can be applied individually or combined with one another as desired in an appropriate manner, form the subject matter of the dependent claims.

The refrigerating device, in particular refrigerator and/or freezer cabinet, according to the invention comprises a heat-insulating housing and a heat-insulating door, whereby at least one component is provided on or in the door, which is connected fluidically or electrically by means of a line to at least one element arranged on the housing, whereby the door is articulated to the housing by means of a multilink hinge.

As a general rule the heat-insulating housing has a wall thickness in a range from 10 mm to 150 mm, in particular in a range from 50 mm to 80 mm. The walls of the housing are as a general rule coated with an insulating foam. The door can have a comparable thickness. The capacity of an inner chamber of the refrigerator is between 50 liters and 500 liters, in particular between 100 liters and 250 liters.

A water dispensing unit, a display unit and/or an input unit for controlling the refrigerator can be provided in the door. These components are connected fluidically and/or electrically by means of a line to at least one element arranged on the housing. For example, the water dispensing unit is connected by way of a hose to a water tank or to a water supply on the device housing of the refrigerator.

Through the use of a multilink hinge, in particular of a hinge having at least four, preferably having seven, pivot pins or having at least three, preferably having at least six, pivoting parts it is possible to implement a rotation/extension motion of the door, by means of which any obstruction of the inner chamber of the refrigerator as a result of the thickness of the door is reduced or avoided. When it opens, the door completes both a rotational and also a translational motion, whereby a current axis of rotation of the door is variable in respect of its location while the door opens in such a manner that the door is lifted out of the door aperture on opening and is swiveled out of this aperture. The multilink hinge has sufficiently large dimensions in order to carry the additional weight of the door caused by the component. The special case of multilink hinges having seven parallel pins and four arms is for example the subject matter of IPC class E05D 3/16.

In a variant of the invention the refrigerating device can also be a hot water or hot drink dispenser for tea and/or coffee and/or soup. In this situation, the hot drink dispenser can have a door for care and maintenance of an inner chamber. The fluidic or electrical connection with the door is advantageously established in the area of the articulated joint.

The component advantageously comprises a dispenser unit for water, in particular cooled water or ice, and the line comprises a hose. The line can furthermore comprise a wiring harness, in particular electrical lines. The component advantageously comprises a display unit or an input unit and the line comprises a cable, in particular a cable loom.

The component comprises in particular an electrically operated final control element, in particular for a valve or a flap valve on the door. The component can for example function electromagnetically. It can have an electric motor for example as an ice-maker. In a particularly advantageous embodiment of the invention a carrier is provided which supports the line when the door is open in an intermediate area between the door and the housing. To this end, in particular the line bears on the carrier and is displaced during the rotation/extension motion of the multilink hinge. The line comprises in particular an electrical cable and/or a hose.

The line can be installed in the form of an arc such that, with little force required and without getting jammed, the line can be pulled out from or pushed into the door or the device housing.

The line is routed in particular in the immediate proximity of the hinge, preferably a little below the hinge. The described electrical or fluidic connection between the door and the device housing occupies comparatively little space in an understructure of the refrigerator and requires no complicated mechanics. In particular, no tube arrangement is required.

The carrier advantageously has a carrier surface along which the line can slide or skid when the door is opened or closed. The carrier surface supports the fluidic or electrical connection and thus enables the door to be opened and closed without getting caught or jamming.

The carrier is advantageously secured to the housing. It is however also possible to secure the carrier on the door. The carrier can be a straight or arced L-profile, whereby in particular the line rests against the inner edge of the L-profile. The line is in particular formed in an arc shape and has a vertical section which can elastically accommodate a twisting of the line without major distortion.

The line runs in particular in immediate proximity beneath the multilink hinge. In this situation, the articulated joint protects the line by covering the line from above.

It is advantageous if the line is at least partially encapsulated by the carrier and the multilink hinge. As a result of the encapsulation, damage to the line is less likely and the line is additionally protected.

The line is routed in particular in an arc in a hinge-side area of the housing. The line advantageously has a vertical section in order to compensate for any torsion occurring when the door is opened. The torsion along the line caused by opening the door can be absorbed elastically without any difficulty by means of the vertical section. For this purpose, the vertical section is advantageously situated in a hinge-side area of the housing.

BRIEF DESCRIPTION OF THE DRAWINGS

Further advantageous details and special embodiments, which in each case can be applied individually or can be combined with one another as desired in an appropriate manner, will be described in detail with reference to the following drawing which is not intended to restrict the invention but merely to illustrate it by way of example.

In the schematic drawings.

DETAILED DESCRIPTION OF THE PRESENT INVENTION

Figure 1:
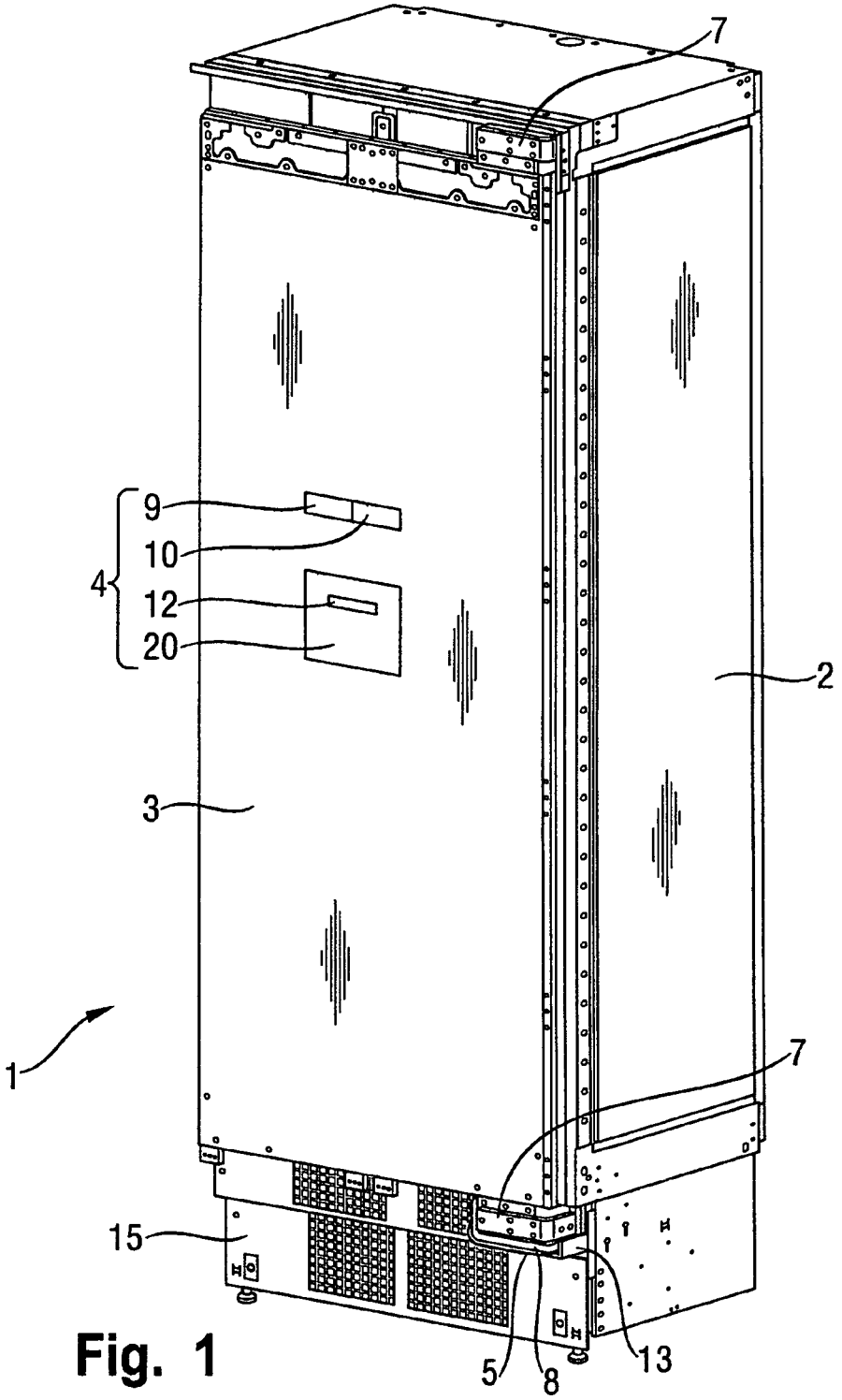
FIG. 1 shows a refrigerating device according to the invention in a perspective view with a water dispensing unit in the door.

FIG. 1 shows a refrigerating device 1 according to the invention in a perspective view with a door 3, which has as one component 4 a display unit 9 and an input unit 10 for controlling the refrigerator 1 and a water dispensing unit 20 for ice pieces with a final control element 12 for an output valve (not shown). The electrical components 9, 10, 12 and also the water dispensing unit 20 are connected by way of a line 5 to a base unit 15 of the refrigerating device 1, whereby the line 5 has a hose 8 for water. The door 3 is connected with the aid of multilink hinges, here a seven-link hinge 7, to a housing 2 of the refrigerator 1. The line 5 is routed in immediate proximity beneath the lower multilink hinge 7 and is supported by a carrier 13 which accommodates the weight of the line 5.

Figure 2:
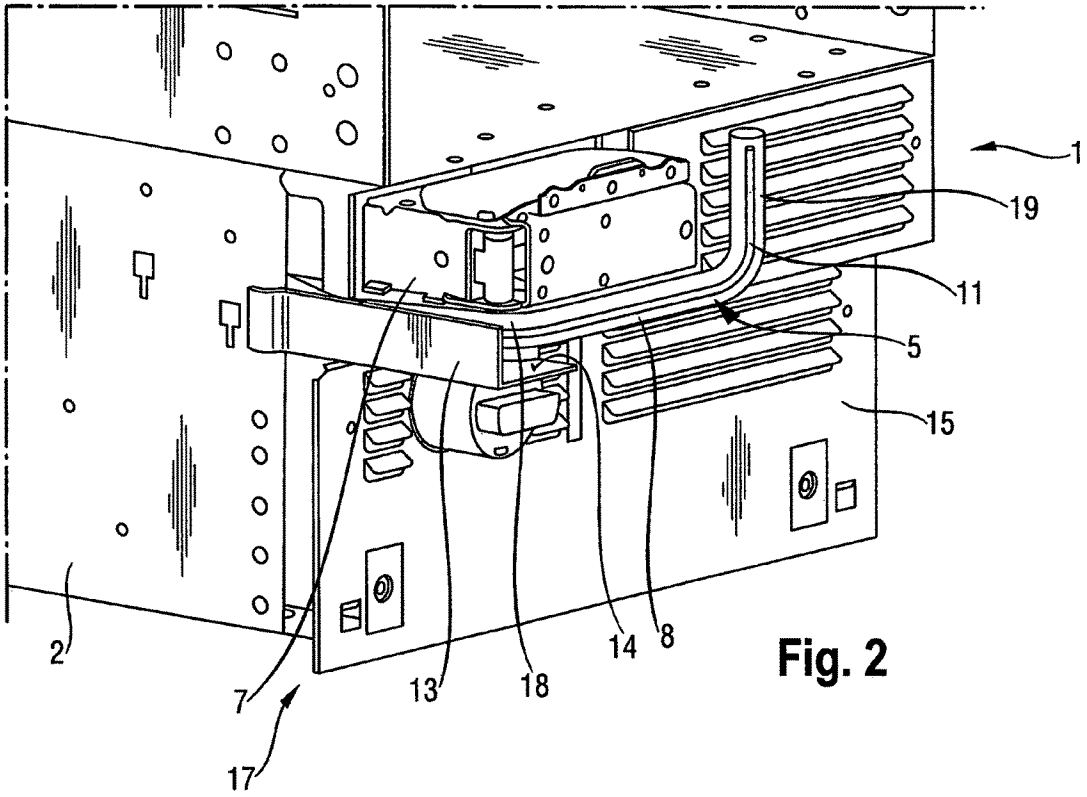
FIG. 2 shows a section of a further refrigerator according to the invention with a demounted door in a perspective view.

FIG. 2 shows a further refrigerating device 1 according to the invention, whereby a door 3 has been demounted in order to better illustrate the multilink hinge 7. The line 5, which consists of a hose 8 and a cable 11, is supported beneath the hinge 7 with the aid of the carrier 13. The carrier has a carrier surface 14 along which the line 5 can skid when the door 3 is opened and closed. The line 5 is routed in a first arc 18 and a second arc 21 in such a manner that a rotation/extension motion of the door 3 can be accommodated elastically on account of the multilink hinge 7 without major distortion of the line 5. The line 5 has a vertical section 11 which likewise elastically cushions the torsion or twisting of the line 5 occurring when the door is opened. The line 5 is brought to the door 3 from the base unit 15 in a hinge-side area 17 of the housing 2.

Figure 3:
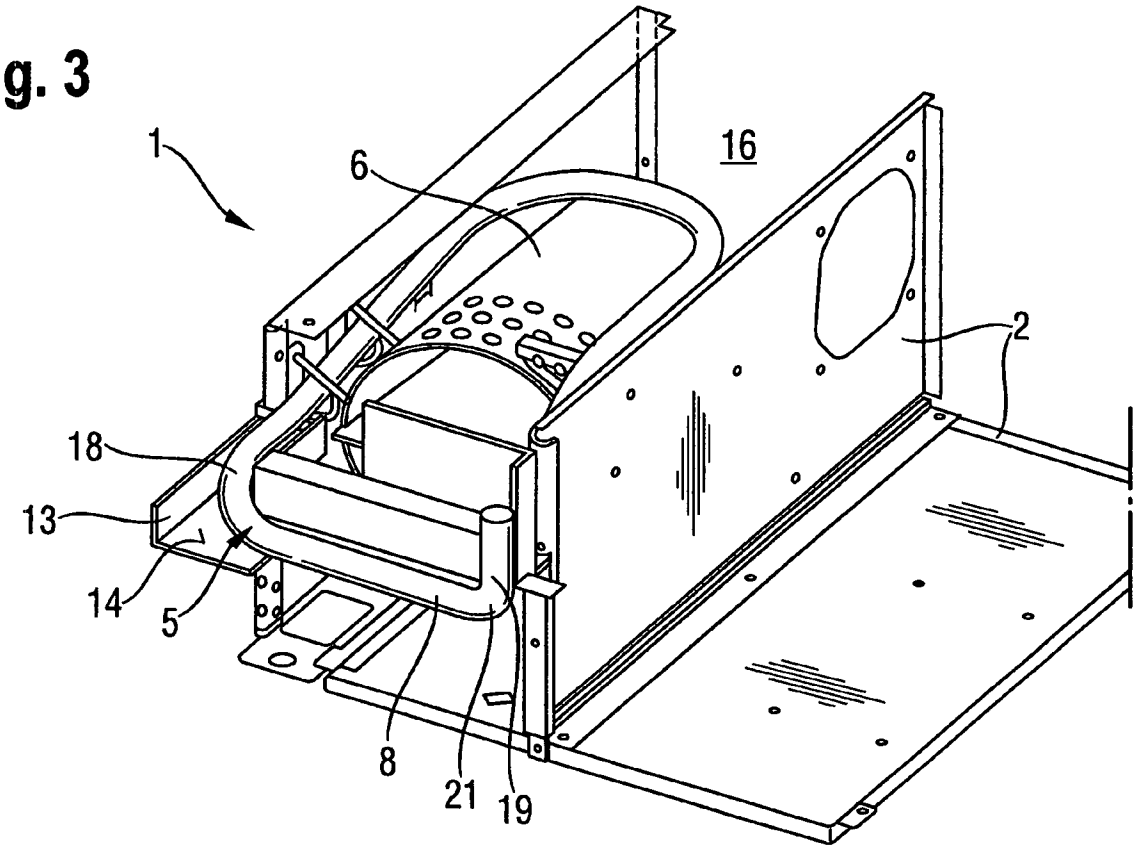
FIG. 3 shows a section of the device according to FIG. 2, whereby merely one part of the machine space and the line in the area of the door connection are illustrated.

FIG. 3 shows the refrigerating device according to FIG. 2, whereby in order to improve clarity further parts of the device housing are not shown. In a machine space 16, which is situated in the base unit 15, is arranged an element 6 from which cooled water is made available to a water dispensing unit (not shown) by way of the hose 8 as a line 5. The element 6 can for example be a water reservoir in which is arranged an evaporator for the water contained therein. When the door 3 is opened, on the one hand the first arc 18 and on the other hand the vertical section 19 is twisted, whereby however the twisting is so slight that the hose 8 is able to accommodate this without any difficulty. The hose 8 is supported by the carrier 13 with the carrier surface 14. As a result of the special guideway provided by the door 3 or the line 5 for the fluidic or electrical connection between an element 6 on the housing 2 and a component 4 in the door 3 a safe and reliable electrical and fluidic connection is created between the housing 2 and the door 3, which however on account of the use of a multilink hinge 7 nevertheless enables free access to an inner chamber (not shown) of the refrigerator 1.

The invention relates to a refrigerating device 1, in particular a refrigerator and/or a freezer cabinet, comprising a heat-insulating housing 2 and a heat-insulating door 3, whereby at least one component 4 is provided on or in the door 3, which is connected fluidically and/or electrically by means of a line 5 to at least one element 6 on the housing 2, whereby the door 3 is articulated to the housing 2 by means of a multilink hinge 7, whereby in particular a carrier 13 is provided which supports the line 5 when the door 3 is open in an intermediate area between the door 3 and the housing 2. The invention is distinguished by the fact that it makes possible almost completely free access to the inner chamber of the refrigerator I even in the case of thick doors 3 even if a water dispensing unit 20 is provided on the door 3.

LIST OF REFERENCE CHARACTERS

1 Refrigerating device
2 Housing
3 Door
4 Component
5 Line
6 Element
7 Multilink hinge
8 Hose
9 Display unit
10 Input unit
11 Cable
12 Final control element
13 Carrier
14 Carrier surface
15 Base unit
16 Machine space
17 Hinge-side area
18 First arc
19 Vertical section
20 Dispenser unit
21 Second arc

The invention claimed is:

1. A refrigerating device comprising:

at least one of a refrigerator and a freezer cabinet, an insulated housing, an insulated door, at least one component that is provided on or in the door, said component being connected at least one of fluidically and electrically using a line to at least one element arranged on the housing, a carrier, and a multilink hinge whereby the door is articulated to the housing, wherein the line, when the insulated door is closed, extends outward from the housing in a substantially horizontal manner, bends horizontally to include a portion substantially horizontal and substantially parallel to a front portion of the insulated door, and bends to include a substantially vertical portion that passes into the door, the carrier supports the line under the multilink hinge, and the line is completely exterior to the multilink hinge.

2. The refrigerating device according to claim 1 wherein the component includes a dispenser unit for water, including at least one of cooled water and ice, and the line includes a hose.

3. The refrigerating device according to claim 1 wherein the component includes at least one of a display unit and an input unit and the line includes a cable, which is formed as at least one of a cable loom and a structure that is not a cable loom.

4. The refrigerating device according to claim 1 wherein the component includes an electrically operated final control element, including at least one of a valve and a flap valve on the door.

5. The refrigerating device according to claim 1 wherein the carrier supports the line when the door is open in an intermediate area between the door and the housing.

6. The refrigerating device according to claim 5 wherein the carrier is formed with a carrier surface below the multilink hinge and along which the line can move when the door is opened or closed.

7. The refrigerating device according to claim 5 wherein the carrier is secured to housing.

8. The refrigerating device according to claim 5 wherein the carrier is formed with an L-shaped profile and the line is supported by the horizontal leg of the L-shaped profile.

9. The refrigerating device according to claim 5 wherein the line is disposed immediately adjacent the multilink hinge.

10. The refrigerating device according to claim 9 wherein the line is at least partially encapsulated between the carrier and the multilink hinge.

11. The refrigerating device according to claim 1 wherein the door executes both a rotation motion and an extension motion using the multilink hinge such that an axis of rotation for the rotation motion moves outward from the insulated housing.

12. The refrigerating device according to claim 1 wherein the line is routed in an arc in a hinge-side area of the housing.

13. The refrigerating device according to claim 1 wherein the line has a vertical section in order to compensate for any torsion occurring when the door is opened.

14. A refrigerating device comprising:

at least one cooled cabinet, an insulated housing, an insulated door, at least one component that is provided on or in the door, said component being connected at least one of fluidically and electrically using a line to at least one element arranged on the housing, a carrier, and a multilink hinge whereby the door is articulated to the housing, wherein the line, when the insulated door is closed, includes a first section adjacent the housing, a second section adjacent the door, a third section disposed between the first and second sections, and the first section, the second section and the third section are mutually orthogonal to one another, the carrier supports the line beneath the multilink hinge, and the line is completely exterior to the multilink hinge.

15. The refrigerating device according to claim 14, wherein the first section, the second section, and the third section form a continuous member.

16. The refrigerating device according to claim 14, wherein the multilink hinge includes a first hinge portion that is substantially parallel to a side of the insulated housing when the door is closed, a second hinge portion that is substantially perpendicular to the side of the insulated housing when the door is closed, the first section is substantially parallel to the first hinge portion when the door is closed, and the third section is substantially parallel to the second hinge portion when the door is closed.

17. The refrigeration device according to claim 16, wherein the second section is substantially vertical.

18. The refrigeration device according to claim 14, wherein the door executes a rotation motion and an extension motion using the multilink hinge such that an axis of rotation for the rotation motion moves outward from the insulated housing.

19. The refrigeration device according to claim 14, wherein, when the door is closed, the line includes a bend between the first section and the third section and the bend is adjacent to a pivot point of the hinge.

20. The refrigeration device according to claim 14, wherein the carrier is adapted to support the line in an intermediate area between the door and the housing when the door is open.

21. The refrigerating device according to claim 1, wherein the multilink hinge provides translational and rotational movement for the insulated door.

22. The refrigeration device according to claim 14, wherein the multilink hinge provides translational and rotational movement for the insulated door.

23. The refrigerating device according to claim 1, wherein the multilink hinge has at least two pivot pins.

24. The refrigerating device according to claim 14, wherein the multilink hinge has at least two pivot pins.

25. The refrigerating device according to claim 1, wherein the carrier supports at least part of the portion substantially horizontal and substantially parallel to the front portion.

26. The refrigerating device according to claim 14, wherein the carrier supports the third section.

* * * * *